US012358749B2

(12) United States Patent
Perla

(10) Patent No.: US 12,358,749 B2
(45) **Date of Patent: *Jul. 15, 2025**

(54) ROLLED PAPER CUTTING DEVICE

(71) Applicant: Bryan Perla, West Boylston, MA (US)

(72) Inventor: Bryan Perla, West Boylston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/635,940

(22) Filed: Apr. 15, 2024

(65) Prior Publication Data

US 2024/0279020 A1 Aug. 22, 2024

Related U.S. Application Data

(63) Continuation of application No. 17/721,308, filed on Apr. 14, 2022, now Pat. No. 11,987,467, which is a continuation-in-part of application No. 15/994,665, filed on May 31, 2018, now abandoned.

(60) Provisional application No. 62/670,840, filed on May 13, 2018, provisional application No. 62/513,474, filed on Jun. 1, 2017.

(51) Int. Cl.
*B65H 35/06* (2006.01)

(52) U.S. Cl.
CPC ... *B65H 35/06* (2013.01); *B65H 2301/51512* (2013.01)

(58) Field of Classification Search
CPC .. B65H 2301/5151; B65H 2301/51512; B65H 271/1944; B65H 35/002; B65H 35/06; B26B 3/08; B26B 29/06; Y10T 225/257; Y10T 225/256; B65D 83/0841; B26D 1/045
USPC ..... 30/124
See application file for complete search history.

(56) References Cited

U.S. PATENT DOCUMENTS 1,739,560 A * 12/1929 Ranck ..... B65H 35/002 225/53
2015/0059188 A1* 3/2015 Haas ..... B26B 3/08 30/279.2

FOREIGN PATENT DOCUMENTS

DE 202012006366 U1 * 11/2013 ..... B26B 27/00

OTHER PUBLICATIONS

English Translation of DE-202012006366-U1 (Year: 2013).*

* cited by examiner

*Primary Examiner* — Jennifer S Matthews
(74) *Attorney, Agent, or Firm* — Schaffer IP Law, LLC

(57) ABSTRACT

The present invention is a rolled paper cutting device and method which safely and easily cuts a variable length sheet of paper from rolled paper, including an adjustable holder for controlling the rolled paper, and a paper cutting blade embedded within a safety slot, the safety slot protecting a user from a blade related injury.

19 Claims, 13 Drawing Sheets

ROLLED PAPER CUTTING DEVICE

CROSS-REFERENCES TO RELATED APPLICATIONS

This application is a continuation and claims the benefit of U.S. patent application Ser. No. 17/721,308 filed Apr. 14, 2022, which is a continuation-in-part, of U.S. patent application Ser. No. 15/994,665 filed May 31, 2018, and also claims the benefit under 35 U.S.C. § 119(e) of U.S. Provisional Application No. 62/670,840 filed May 13, 2018, and also claims the benefit under 35 U.S.C. § 119(e) of U.S. Provisional Application No. 62/513,474 filed Jun. 1, 2017, all of which are hereby incorporated by reference.

BACKGROUND OF THE INVENTION

2. Field of the Invention

This invention is a device that is used for cutting sheets from rolled paper.

3. Description of the Prior Art

Cutting rolled paper is a universal task and tools currently available lead only to universal frustration. The present invention is the universal solution. The outdated way of cutting rolled paper into sheets has never worked very well, because the slice is either jagged, ripped, or crooked. People have been using scissors and EXACTO blades for cutting rolled paper since the 1920s, and these devices are simply not adequate. Current methods and devices waste paper and consumer's time. People have tried blades, knives, and sharper scissors, but those devices are not safe and put the consumer's, including children's, safety in danger. During the holidays, when rolled wrapping paper is most frequently used, and when people have the least amount of time to wrap presents including working with rolled paper, consumers continue to spend hours upon hours fussing with dull scissors and unsafe blades. And ending up with results that are often far from perfect. Without an obvious alternative these appear to the consumer to be the most effective tools for cutting rolled wrapping paper. How we cut wrapping paper needs to change both for efficiencies and for safeties sake.

These and other difficulties experienced with the prior art devices have been obviated in a novel manner by the present invention.

It is, therefore, an outstanding object of some embodiments of the present invention to solve these problems in a simple way. Simply put, the present invention is a large improvement in cutting rolled wrapping paper and provides a device and method that is efficient and effective.

Another object of some embodiments of the present invention is to make cutting rolled wrapping paper easy.

A further object of some embodiments of the present invention is to make a monotonous wrapping task fun.

It is another object of some embodiments of the present invention to improve the cutting of rolled wrapping paper by making the slice free of jaggedness, ripped sections, or crooked cuts.

It is a further object of some embodiments of the present invention to minimize the wasting of rolled paper as well as minimizing the time needed to actually wrap a package with rolled wrapping paper.

It is another object of some embodiments of the present invention to provide a device that is safe for consumers and particularly for children that often are involved in wrapping presents during the holidays.

It is another object of some embodiments of the present invention to provide a device that, during the holidays, when rolled wrapping paper is most frequently used, allows for consumers to spend the least amount of time necessary wrapping presents.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

SUMMARY OF THE INVENTION

The present invention is a device that is used for cutting sheets from rolled paper. The invention allows users to keep the paper rolled while simultaneously cutting a single sheet of paper safely and with ease. The invention includes a constraining holder for rolled paper, allowing users to engage the embedded cutting blade with an unrolled section of paper to cut off a sheet while simultaneously maintaining control of the paper which remains on the roll. The invention also makes use of a paper cutting blade embedded within a slot to protect the user. The invention furthermore is adjustable to fit varying diameter rolls of paper. The invention works by sliding the device over the paper roll and feeding the paper through a slot in the device. And, once the paper is in the proper position, the user gently pushes the device, producing a cleanly cut slice of paper.

One embodiment of the invention includes a flexible hinge, an embedded blade, a simple construction of durable plastic, a safety lip feature that protects the user's hand from coming in contact with the sharp cutting blade.

BRIEF DESCRIPTION OF THE DRAWINGS

The character of the invention, however, may best be understood by reference to one of its structural forms, as illustrated by the accompanying drawings, in which.

DETAILED DESCRIPTION

The present invention is a paper cutter device that cuts a sheet from rolled paper. The device is a safety enabled paper cutter that also acts as a tool used to hold rolled paper together, preventing it from unrolling and becoming disorganized.

Figure 1:
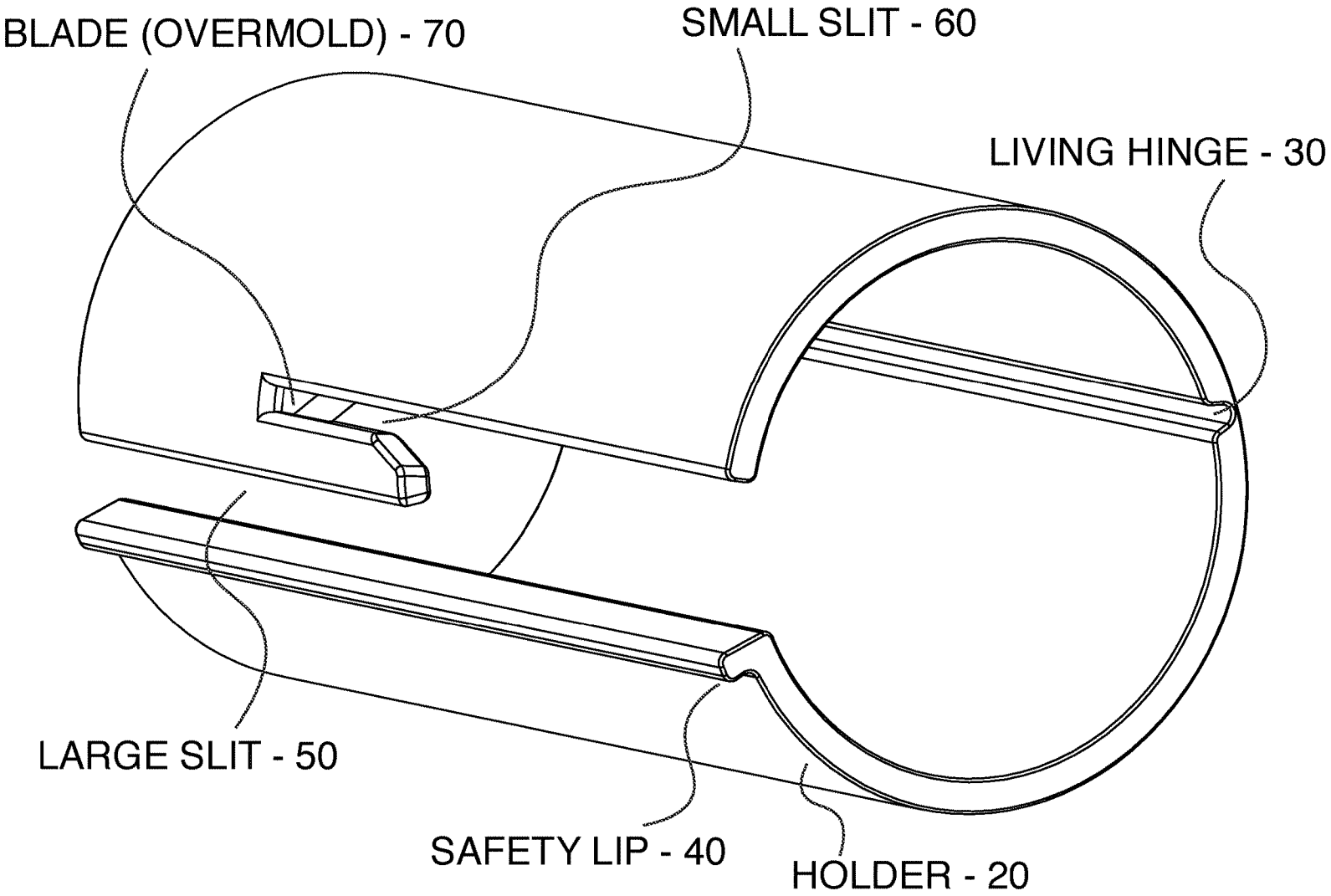
FIG. 1 shows a front view of an embodiment of the present invention including the holder with a front end and back end, the hinge (living), the full-length dispensing interstice (large slit), the safety lip, the partial length knife engagement interstice (small slit), and the embedded paper cutting knife blade (overmold).

As shown in FIG. 1, the rolled paper cutter 10 comprises a cylindrical rolled paper holder 20, a full-length dispensing interstice (large slit) 50, a partial length knife engagement interstice (small slit) 60, and an embedded paper cutting knife blade 70. The partial length knife engagement interstice (small slit) 60 includes the embedded paper cutting knife blade 70 within it, which knife blade 70 provides the means for slicing the rolled paper 80 and causing the sheet of paper 90 to detach from the rolled paper 80.

The method of cutting rolled paper using the present device includes extending the sheet of paper out to its appropriate length, positioning the holder 20 at the starting end 100 of the rolled paper 80, sliding the edge of the sheet of paper 90 into the partial length knife engagement interstice (small slit) 60, engaging the sheet of paper 90 with the knife blade 70 by moving the paper cutting device 20 forward towards the finish end 110 of the rolled paper 80, while the rolled paper 80 is guided within the partial length knife engagement interstice (small slit) 60, and at the point where the paper cutting device 20 reaches the finish end 110 of the rolled paper 80, cleanly slicing off the sheet of paper 90 from the rolled paper 80.

Figure 2:
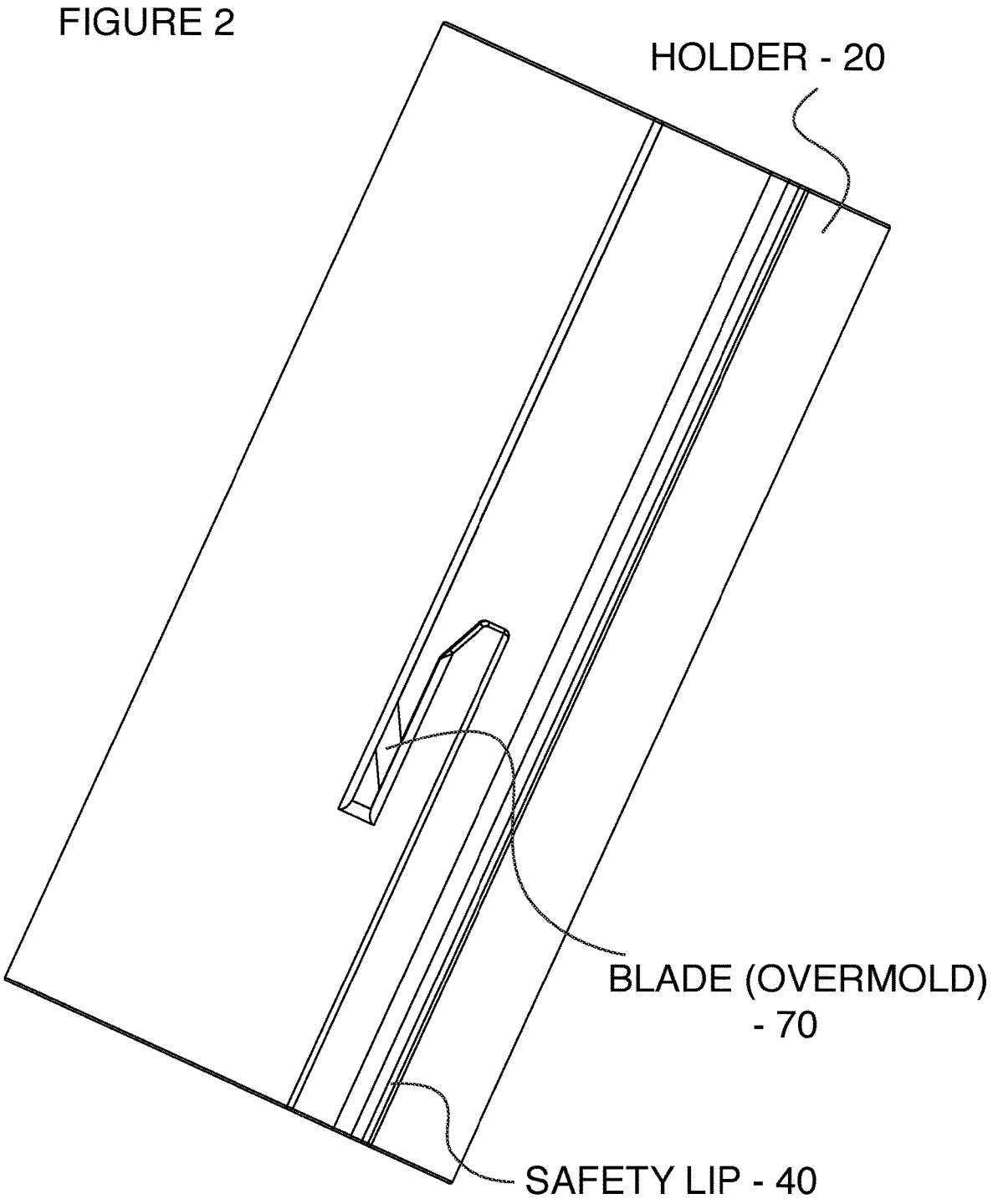
FIG. 2 shows a side view of an embodiment of the present invention including the holder, the safety lip, and the knife blade (overmold)

As shown in FIG. 2, the paper cutter 10 comprises a safety lip 40 that runs parallel to and on the outward facing edge of the full-length dispensing interstice (large slit) 50. The full-length dispensing interstice (large slit) 50 is the means by which the sheet of paper 90 is properly dispensed and then cut to the appropriate length. There is also a partial length knife engagement interstice (small slit) 60 which acts as a guide for the sheet of paper 90 during the cutting process.

Figure 3:
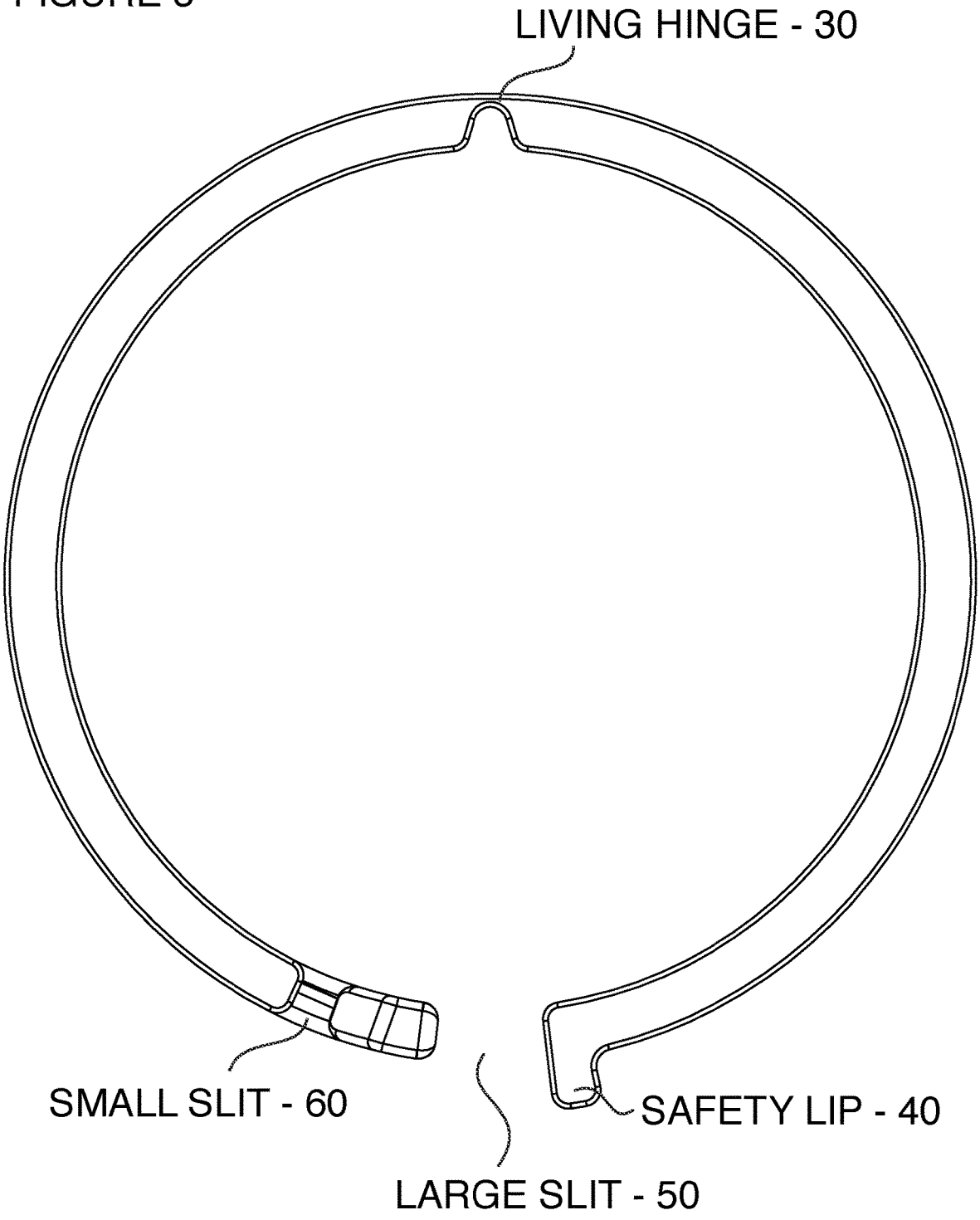
FIG. 3 shows an end view of an embodiment of the present invention including the living hinge, the safety lip, the full-length dispensing interstice (large slit), and the partial length knife engagement interstice (small slit).

As shown in FIG. 3, the paper cutter device 10 is generally cylindrical that enables the holder 20 to fit around rolled paper 80 (such as wrapping paper). The holder 20 is able to compress using the hinge (living) 30 in order for it to fit snuggly around the rolled paper even as the circumference of the rolled paper 80 decreases as it is gradually unrolled with use.

To summarize, the rolled paper cutter device 10 allows a user to cut the rolled paper 80 (such as wrapping paper) more effectively, efficiently, and safely.

Figure 4:
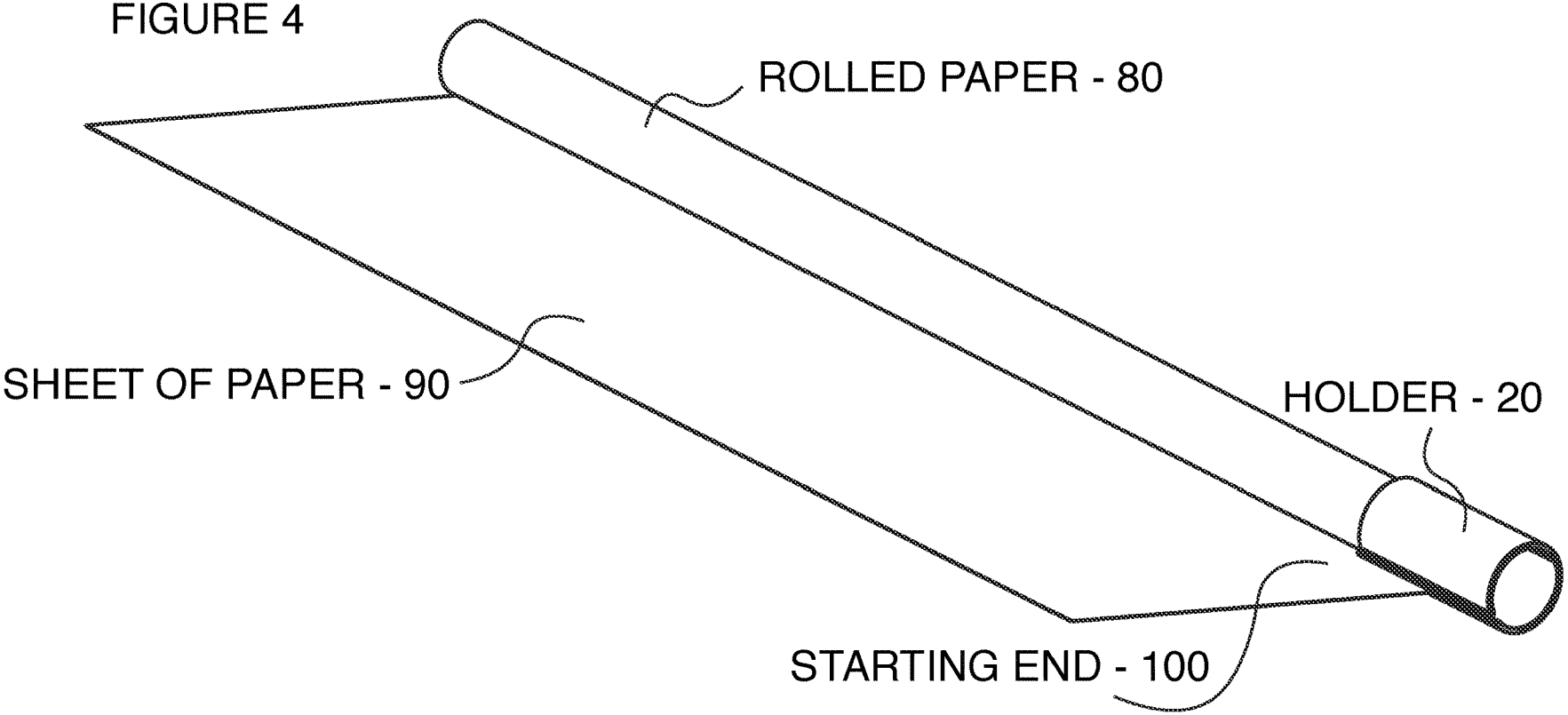
FIG. 4 shows a general view of an embodiment of the present invention with the paper cutting device situated at the starting end of the rolled paper.
Figure 5:
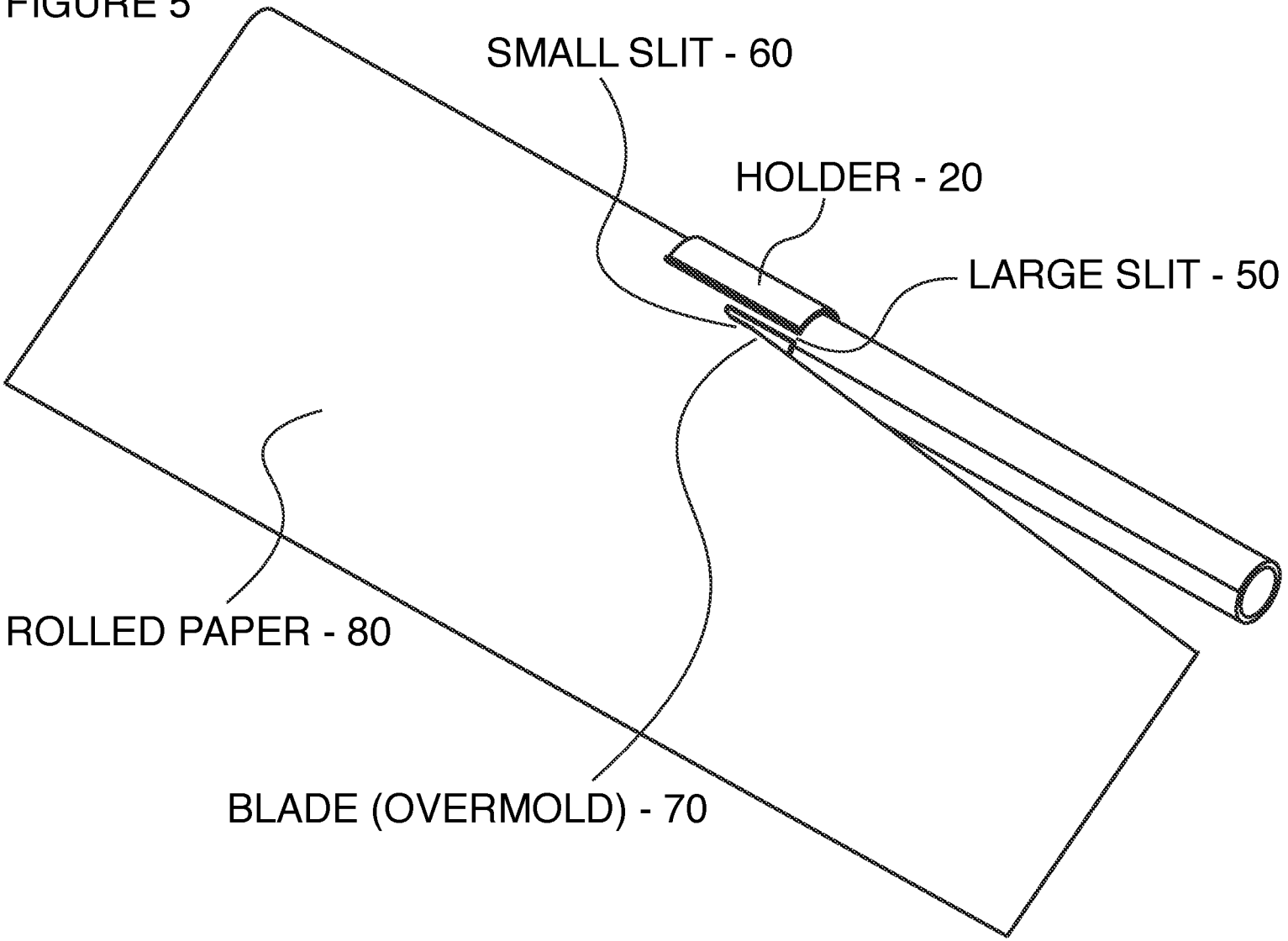
FIG. 5 shows a general view of an embodiment of the present invention with the paper cutting device situated at the midway point of the rolled paper, after having sliced halfway through the sheet of paper.
Figure 6:
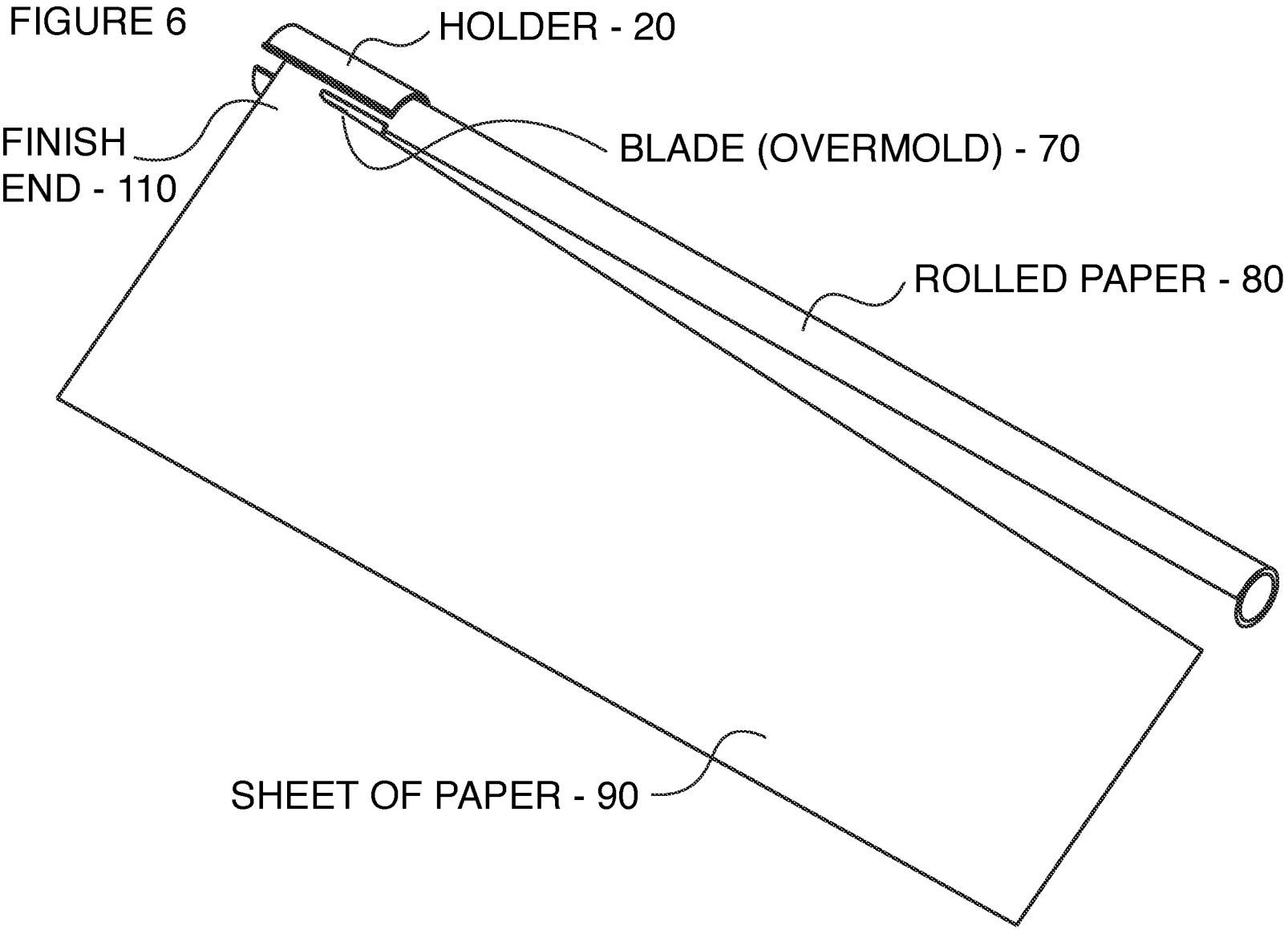
FIG. 6 shows a general view of an embodiment of the present invention showing the paper cutting device situated at the finish end of the rolled paper.

The method of using the rolled paper cutter device 10 involves sliding the paper cutter device 10 over the rolled paper 80 as seen in FIG. 4, FIG. 5, and FIG. 6. The hinge (living) 30 allows the paper cutter device 10 to be useful for variable circumferences of rolled paper 80. Once the paper cutter device 10 is in place, as shown in FIG. 4, the paper cutter device 10 can be slid over the rolled paper 80.

Once the holder 20 is positioned around the rolled paper 80, as also shown in FIG. 4, the sheet of paper 90 is extended through the full-length dispensing interstice (large slit) 50 to the desired length. Following this, the paper cutter device 10 is placed at the starting end 100 of the rolled paper 80 allowing the extended sheet of paper 90 to engage with the partial length knife engagement interstice (small slit) 60 where the knife blade (overmold) 70 is located. In this manner, the sheet of paper 90 is positioned to be cut, with the holder 20 in the starting end 100 of the rolled paper 80 and the sheet of paper 90 engaged with the knife blade (overmold) 70 that is embedded at the closed end of the partial length knife engagement interstice (small slit) 60.

At this point, the holder 20 is moved forward as seen in FIG. 5 and FIG. 6, engaging the sheet of paper 90 with the knife blade 70 which slices the sheet of paper 90 off of the rolled paper 80. As the paper cutter device 10 is slid forward, the sheet of paper 90 comes in contact with the knife blade 70 which causes the sheet of paper 90 to detach from the rolled paper 80. When the sheet of paper 90 is completely disengaged from the rolled paper 80, the paper cutter device 10 having moved from the starting end 100 of the rolled paper 80 to the finish end 110 of the rolled paper 80 and the sheet of paper 90, as shown in FIG. 6, is disengaged from the rolled paper 80.

Finally, the holder 20 is positioned towards the center of the rolled paper 80, so, the paper cutter device 10 thereby provides a convenient means for holding the rolled paper 80 tightly, keeping the paper roll 80 from unravelling, unrolling or becoming disorganized.

The Slot Design

One of the important aspects of this invention is the smooth and consistent manner in which the uncut paper 90 is cut in the slot 60 of the paper cutter 20. As the leading edge 92 of the uncut paper 90 is immobilized by being pressed between the paper cutter 20 and the rolled paper 80, and is fed into the slot 60, the leading edge 92 is fed to the lower edge 62 of the slot 60 by the funnel shaped element 64 at the opening 66 of the slot 60. As the leading edge 92 of the uncut paper 90 passes along the slot 60, the leading edge 92 of the uncut paper 90 tends to stay against the lower edge 62 of the slot 60 and therefore first touches the forward edge 72 of the blade 70. As a result, the leading edge 92 of the sheet of paper 90 contacts the forward edge 72 of the blade 70 and the leading edge 92 of the uncut paper 90 and is pushed against and slides along the blade edge 74, toward the back 76 of the blade 70. The result is that the sliding contact between the leading edge 92 of the uncut paper 90 and the blade edge 74 results in a "saw action" even though the blade is relatively sharp and smooth. This is because, no matter how carefully the sharp edge of the blade is prepared, it necessarily has some microscopic imperfections which saw the uncut paper 90 as the leading edge 92 of the paper moves upward along the blade edge 74. Ideally, the leading edge 92 of the paper 90 is fully cut a short distance along the sharp edge 74 of the blade 70, but it is normally and consistently cut before it reaches the upper end 78 of the blade edge 74. Thus, as the paper cutter 20 moves axially along the roll 80, the leading edge 92 of the sheet of paper 90 is separated from the roll 80, and the sheet of paper 90 is smoothly and completely separated from the roll 80.

Figure 7:
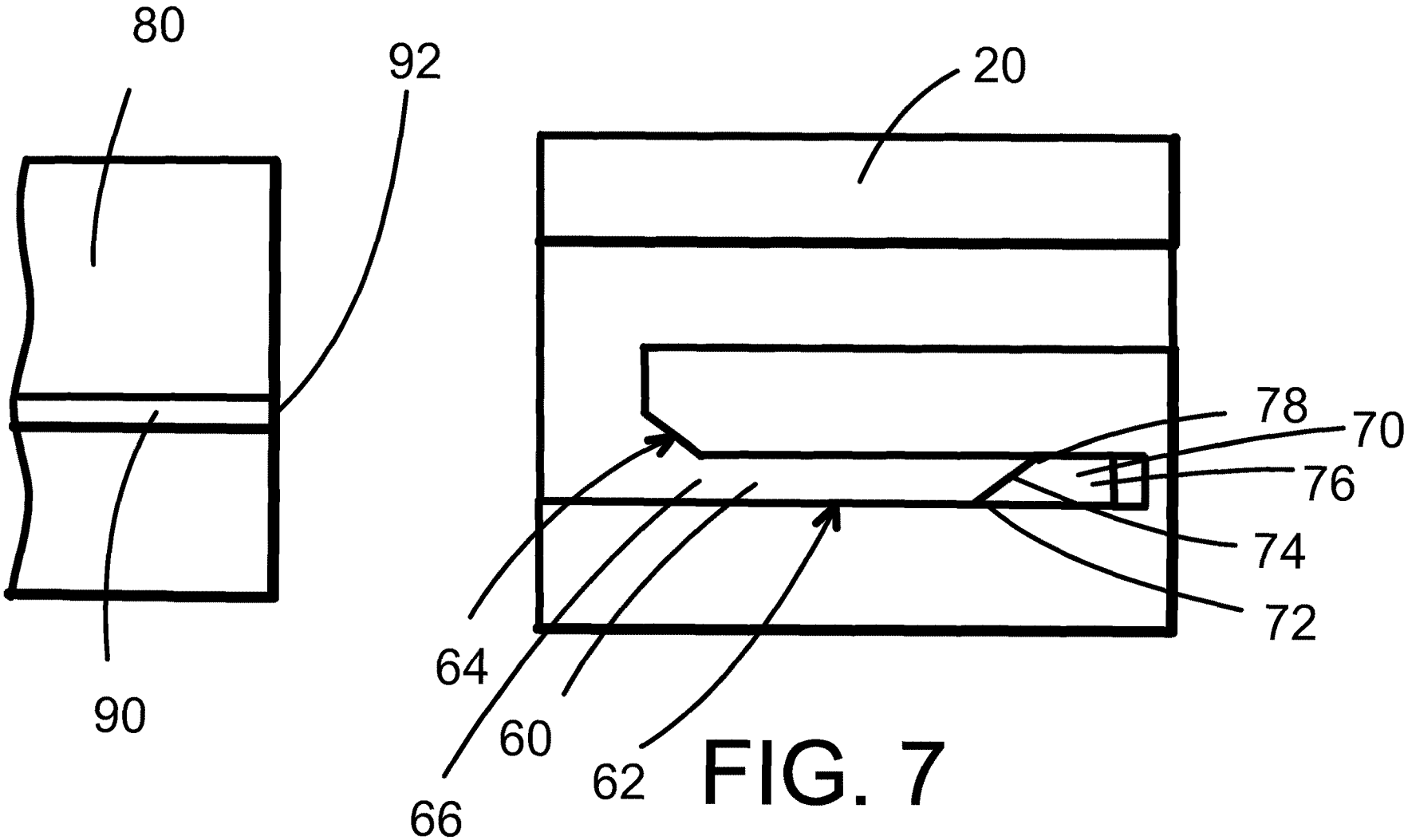
FIG. 7 shows the roll of paper and the paper cutter separated from one another and prior to the process of cutting a sheet of paper off of the roll.

More specifically, FIG. 7 shows the roll of paper and the paper cutter separated from one another and prior to the process of cutting a sheet of paper off of the roll.

Figure 8:
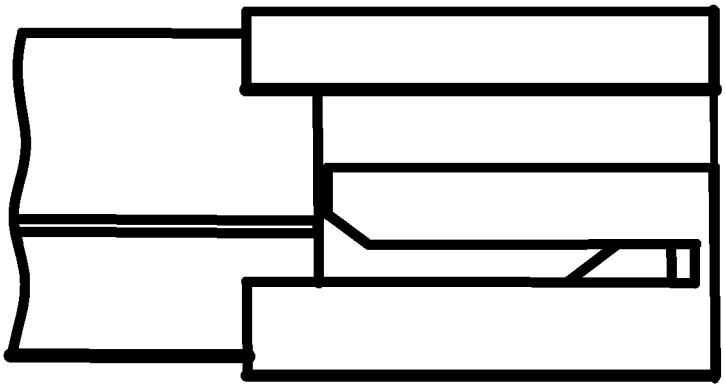
FIG. 8 shows the roll of paper as it enters the paper cutter and before the forward edge of the paper contacts the funnel shaped element at the opening of the slot.

FIG. 8 shows the roll of paper as it enters the paper cutter and before the forward edge of the paper contacts the funnel shaped element at the opening of the slot.

Figure 9:
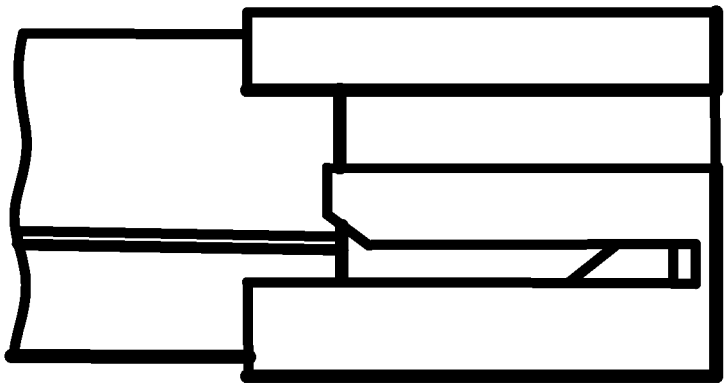
FIG. 9 shows the roll of paper as it enters the paper cutter and as the forward edge of the paper contacts the funnel shaped element at the opening of the slot and is fed into the slot.

FIG. 9 shows the roll of paper as it enters the paper cutter and as the forward edge of the paper contacts the funnel shaped element at the opening of the slot and is fed into the slot.

Figure 10:
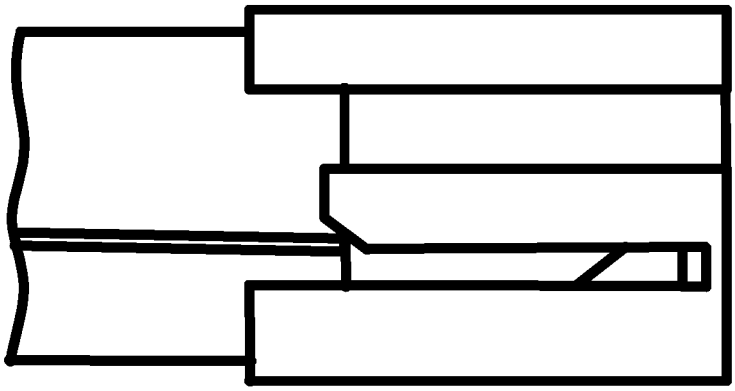
FIG. 10 shows the roll of paper as it further enters the paper cutter and as the forward edge of the paper contacts the funnel shaped element at the opening of the slot and is further fed into the slot.

FIG. 10 shows the roll of paper as it further enters the paper cutter and as the forward edge of the paper contacts the funnel shaped element at the opening of the slot and is further fed into the slot.

Figure 11:
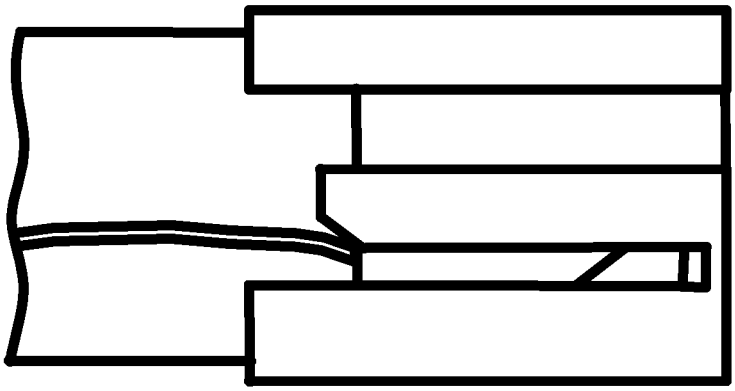
FIG. 11 shows the roll of paper as it further enters the paper cutter and as the forward edge of the paper contacts the funnel shaped element at the opening of the slot and is further fed into the slot.

FIG. 11 shows the roll of paper as it further enters the paper cutter and as the forward edge of the paper contacts the funnel shaped element at the opening of the slot and is further fed into the slot.

Figure 12:
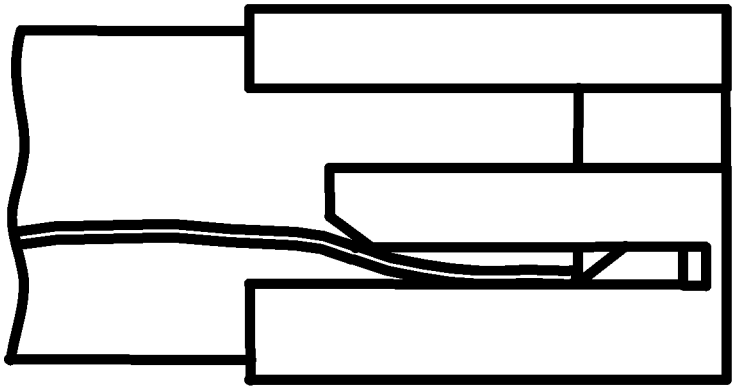
FIG. 12 shows the roll of paper as it even further enters the paper cutter and as the forward edge of the paper contacts the funnel shaped element at the opening of the slot, and is even further fed into the slot, and contacts the cutting blade.

FIG. 12 shows the roll of paper as it even further enters the paper cutter and as the forward edge of the paper contacts the funnel shaped element at the opening of the slot, and is even further fed into the slot, and contacts the cutting blade.

Figure 13:
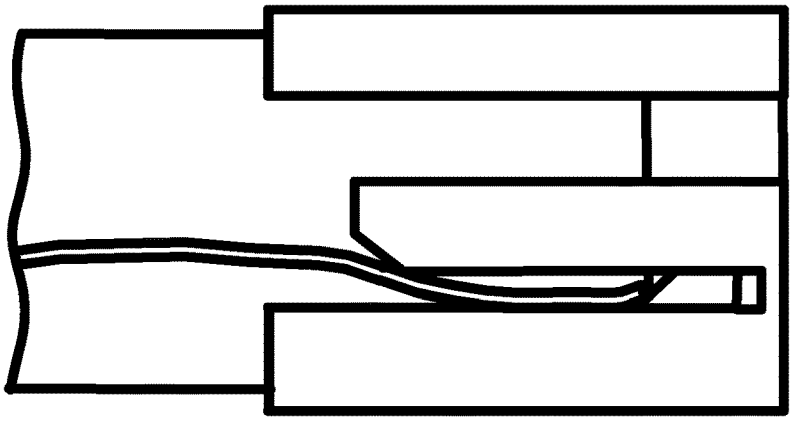
FIG. 13 shows the roll of paper as it even further enters the paper cutter and as the forward edge of the paper contacts the funnel shaped element at the opening of the slot, and is even further fed into the slot, and begins to be cut by the cutting blade.

FIG. 13 shows the roll of paper as it even further enters the paper cutter and as the forward edge of the paper contacts the funnel shaped element at the opening of the slot, and is even further fed into the slot, and begins to be cut by the cutting blade.

Figure 14:
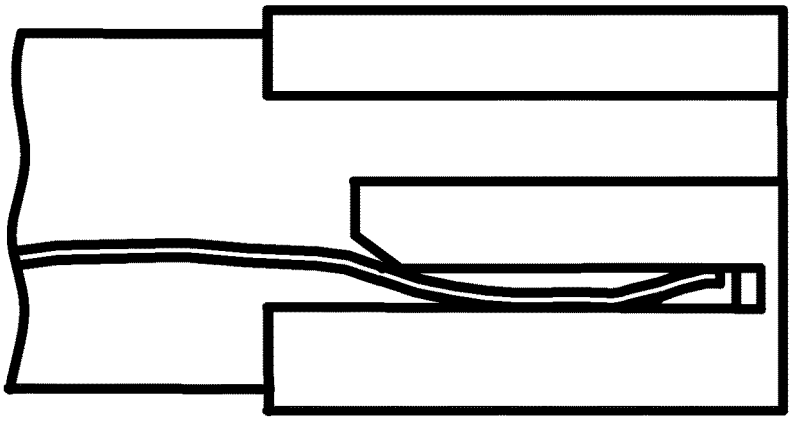
FIG. 14 shows the roll of paper as it even further enters the paper cutter and as the forward edge of the paper contacts the funnel shaped element at the opening of the slot, and is even further fed into the slot, and is substantially cut by the cutting blade.

FIG. 14 shows the roll of paper as it even further enters the paper cutter and as the forward edge of the paper contacts the funnel shaped element at the opening of the slot, and is even further fed into the slot, and is substantially cut by the cutting blade.

Figure 15:
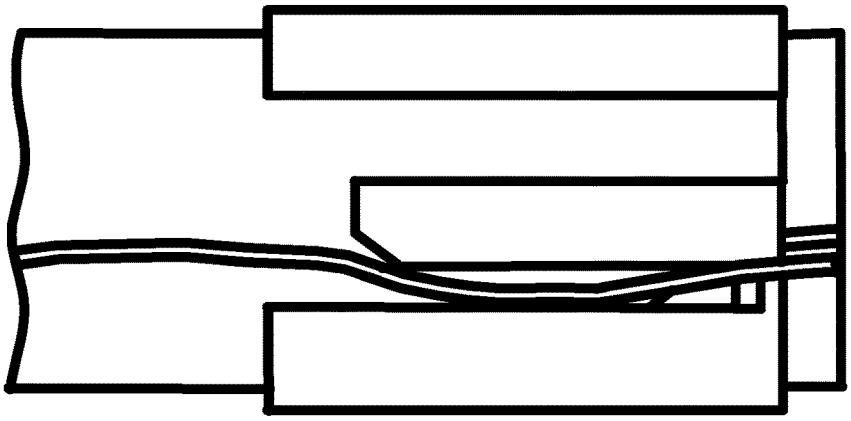
FIG. 15 shows the roll of paper as it emerges from the paper cutter. It can be seen that a sheet of paper is being partially split off of the roll.

FIG. 15 shows the roll of paper as it emerges from the paper cutter. It can be seen that a sheet of paper is being partially split off of the roll. The split off continues as the paper cutter is moved to the left along the roll of paper. Eventually, the paper cutter will come off of the paper roll, and the sheet of paper will be completely and neatly severed from the paper roll

Variation in the Slot Design

It has been found that the smooth and consistently perfect cutting of the sheet of paper 90 can be further enhanced by a variation in the profile of the cutting slot.

Figure 16:
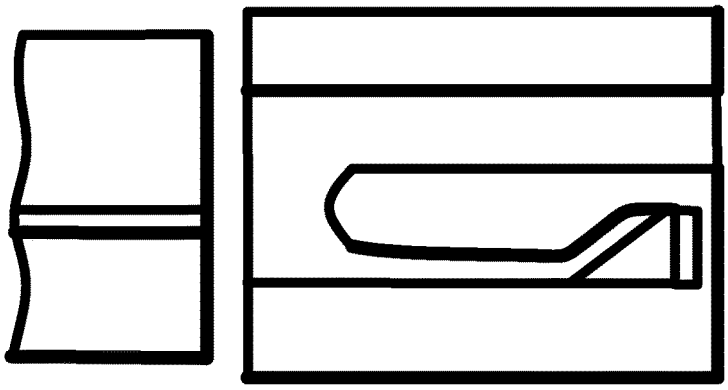
FIG. 16 shows a variation of the paper cutter shown in FIG. 7. The modification is an enlargement of the blade chamber at the blade end of the slot 60 to form the modified slot 60A. Preferably, the depth of the slot 60A is narrower than the slot 60 in order to guide the leading edge of the paper even more reliably into contact with the lowest point on the blade.

FIG. 16, shows a variation of the paper cutter shown in FIG. 7. The modification is an enlargement of the blade chamber at the blade end of the slot 60 to form the modified slot 60A. Preferably, the depth of the slot 60A is narrower than the slot 60 in order to guide the leading edge of the paper even more reliably into contact with the lowest point on the blade. Then, because the broadened blade chamber allows a longer length blade edge to be exposed, the certainty of the paper being fully severed before it reaches the upper end of the blade edge is increased. This allows the paper cutter to be more reliable on more difficult-to-cut paper. It also extends the effective life of the paper cutter, since, as the blade dulls, there is extra length of the blade edge to complete the paper severing function.

More specifically, FIG. 16 shows the roll of paper and the paper cutter separated from one another and prior to the process of cutting a sheet of paper off of the roll.

Figure 17:
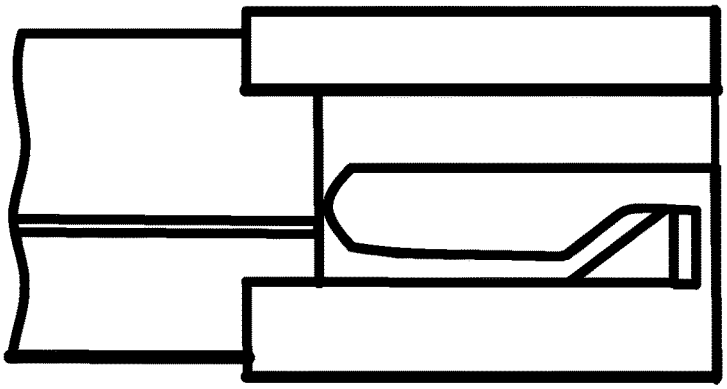
FIG. 17 shows the roll of paper as it enters the paper cutter and before the forward edge of the paper contacts the funnel shaped element at the opening of the slot.

FIG. 17 shows the roll of paper as it enters the paper cutter and before the forward edge of the paper contacts the funnel shaped element at the opening of the slot.

Figure 18:
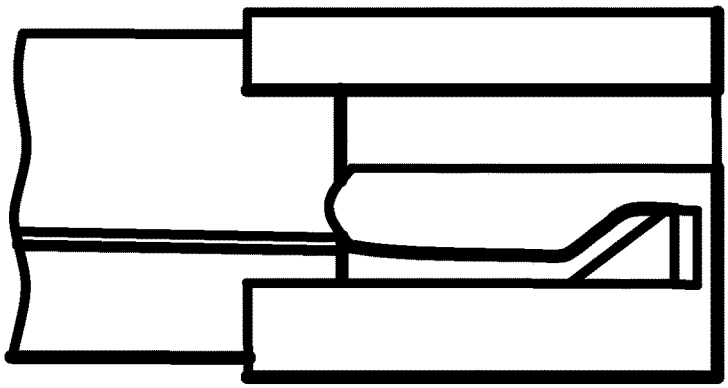
FIG. 18 shows the roll of paper as it enters the paper cutter and as the forward edge of the paper contacts the funnel shaped element at the opening of the slot and is fed into the slot.

FIG. 18 shows the roll of paper as it enters the paper cutter and as the forward edge of the paper contacts the funnel shaped element at the opening of the slot and is fed into the slot.

Figure 19:
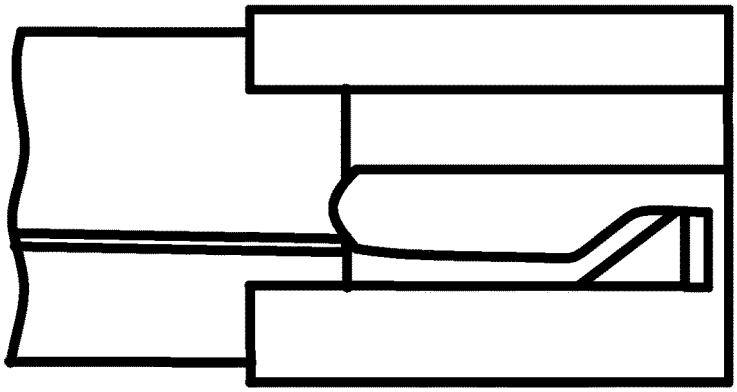
FIG. 19 shows the roll of paper as it further enters the paper cutter and as the forward edge of the paper contacts the funnel shaped element at the opening of the slot and is further fed into the slot.

FIG. 19 shows the roll of paper as it further enters the paper cutter and as the forward edge of the paper contacts the funnel shaped element at the opening of the slot and is further fed into the slot.

Figure 20:
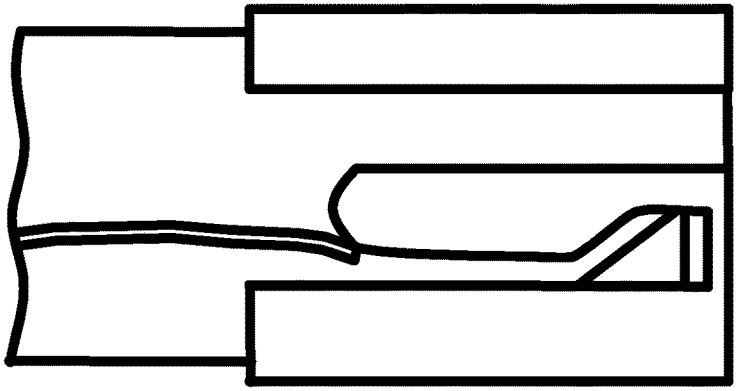
FIG. 20 shows the roll of paper as it further enters the paper cutter and as the forward edge of the paper contacts the funnel shaped element at the opening of the slot and is further fed into the slot.

FIG. 20 shows the roll of paper as it further enters the paper cutter and as the forward edge of the paper contacts the funnel shaped element at the opening of the slot and is further fed into the slot.

Figure 21:
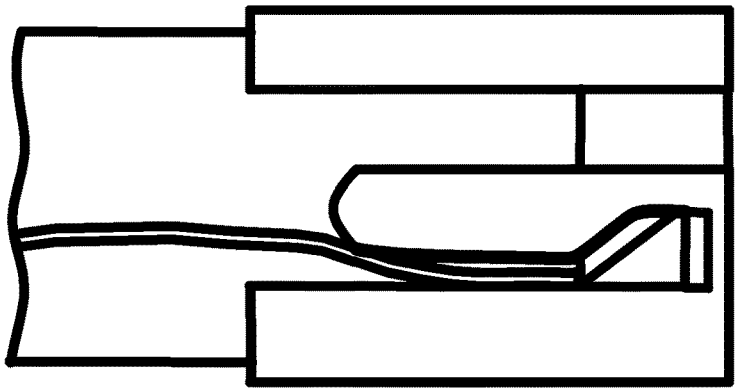
FIG. 21 shows the roll of paper as it even further enters the paper cutter and as the forward edge of the paper contacts the funnel shaped element at the opening of the slot, and is even further fed into the slot, and contacts the cutting blade.

FIG. 21 shows the roll of paper as it even further enters the paper cutter and as the forward edge of the paper contacts the funnel shaped element at the opening of the slot, and is even further fed into the slot, and contacts the cutting blade.

Figure 22:
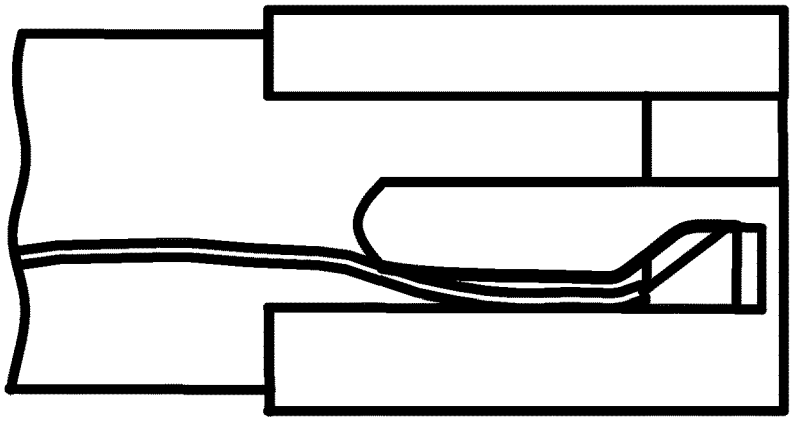
FIG. 22 shows the roll of paper as it even further enters the paper cutter and as the forward edge of the paper contacts the funnel shaped element at the opening of the slot, and is even further fed into the slot, and begins to be cut by the cutting blade.

FIG. 22 shows the roll of paper as it even further enters the paper cutter and as the forward edge of the paper contacts the funnel shaped element at the opening of the slot, and is even further fed into the slot, and begins to be cut by the cutting blade.

Figure 23:
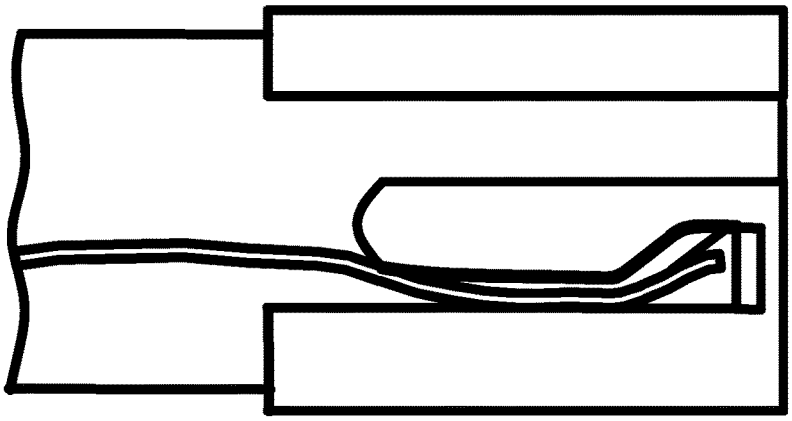
FIG. 23 shows the roll of paper as it even further enters the paper cutter and as the forward edge of the paper contacts the funnel shaped element at the opening of the slot, and is even further fed into the slot, and is substantially cut by the cutting blade.

FIG. 23 shows the roll of paper as it even further enters the paper cutter and as the forward edge of the paper contacts the funnel shaped element at the opening of the slot, and is even further fed into the slot, and is substantially cut by the cutting blade.

Figure 24:
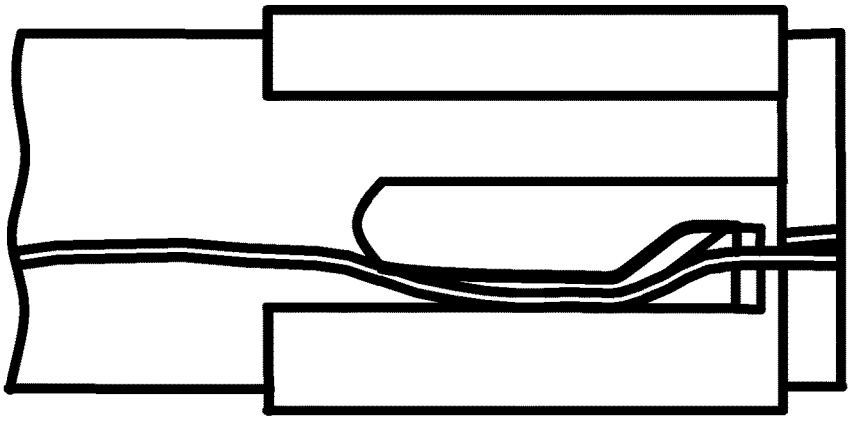
FIG. 24 shows the roll of paper as it emerges from the paper cutter. It can be seen that a sheet of paper is being partially split off of the roll. The split off continues as the paper cutter is moved to the left along the roll of paper. Eventually, the paper cutter will come off of the paper roll, and the sheet of paper will be completely and neatly severed from the paper roll.

FIG. 24 shows the roll of paper as it emerges from the paper cutter. It can be seen that a sheet of paper is being partially split off of the roll. The split off continues as the paper cutter is moved to the left along the roll of paper. Eventually, the paper cutter will come off of the paper roll, and the sheet of paper will be completely and neatly severed from the paper roll It is obvious that minor changes may be made in the form and construction of the invention without departing from the material spirit thereof. It is not, however, desired to confine the invention to the exact form herein shown and described, but it is desired to include all such as properly come within the scope claimed.

What is claimed is:

1. A paper cutting device comprising:

a rolled paper holder configured to receive an elongated section of a roll of paper within a hollow interior bounded by a sidewall having a sidewall thickness thereof, said rolled paper holder having an open front end, an open back end and a middle section between the front end and the back end defining a length along a long axis thereof;

an interstice parallel to the long axis of the rolled paper holder and running from the open front end and along at least a substantial length of the sidewall of the rolled paper holder toward the back end, the interstice defining an elongated gap formed in the sidewall of the holder and bounded by the approximate sidewall thickness of the holder and between a first edge of along a top portion of the rolled paper holder and an opposing first edge along a bottom portion of the rolled paper holder substantially facing the first edge along the top portion; and a paper cutting knife blade disposed in the elongated gap between the first edge of the top portion of the holder and the first edge of the bottom portion of the holder and including a sharp edge that faces towards the front end of the rolled paper holder, said sharp edge configured to cut a leading edge of the elongated section of rolled paper received within the rolled paper holder.

2. The paper cutting device of claim 1, wherein the interstice runs axially along an entire length of the sidewall from the open front end to the open back end and including a hinge configured to pivot the top portion of the rolled paper holder with respect to the bottom portion responsive to compressive pressure applied by a user to exterior surfaces of the top and bottom portions of the rolled paper holder to thereby decrease a spacing distance between the exposed elongated edge and the opposed elongated edge, said hinge running axially along the rolled paper holder from the front end to the back end.

3. The paper cutting device as recited in claim 1, wherein the sharp edge of the paper cutting knife blade includes a forward edge and a back edge, the forward edge being disposed closer to the open front end of the rolled paper holder than the back edge of the paper cutting knife blade and configured so that the leading edge of the elongated section of rolled paper received within the rolled paper holder first contacts the forward edge and slides along the sharp edge of the paper cutting knife blade toward the back edge.

4. The paper cutting device of claim 1, wherein the interstice runs axially along an entire length of the sidewall from the open front end to the open back end, the paper cutting device further including a slot within the interstice having a paper receiving end exposed to the open front end of the rolled paper holder and a closed back end, whereby the paper cutting knife blade is embedded within the closed back end of the slot.

5. The paper cutting device of claim 4, wherein the slot includes a paper cutting guide at a forward portion thereof, said paper cutting guide having a funnel shaped element configured to guide the leading edge of the rolled paper into the slot and against the paper cutting knife blade.

6. The paper cutting device of claim 5, wherein the funnel shaped element includes an angled surface that narrows a width of the slot from the forward portion rearwardly along the slot, wherein the slot is substantially parallel to the interstice.

7. The paper cutting device of claim 6, wherein the width of the slot is configured with a wide forward portion, a narrowed middle portion, and wide rearward portion adjacent the paper cutting knife blade.

8. The paper cutting device of claim 1, wherein the paper cutting knife blade is embedded adjacent a back end of the interstice.

9. A method for cutting rolled paper into sheets of paper comprising the steps of:

receiving an elongated section of a roll of paper, including uncut paper, within a hollow interior of a rolled paper holder having top and bottom portions, a long axis between open front and back ends thereof, and a sidewall having a sidewall thickness thereof;

guiding a leading edge of the uncut paper into a gap, defined through the sidewall of the rolled paper holder between the top and bottom portions of the holder and bounded by the approximate sidewall thickness of the holder between a first edge along the top portion of the rolled paper holder and an opposing first edge along the bottom portion of the rolled paper holder substantially facing the first edge along the top portion, via a funnel-shaped element so that it is directed toward a lower portion of the gap as the leading edge of the uncut paper moves toward a back end of the gap; and contacting the leading edge of the uncut paper against a forward edge of a blade adjacent the lower portion of the gap so that it slides along a length of the blade toward a back edge of the blade and the leading edge is separated from the roll of paper.

10. The method of claim 9, wherein the contacting step results in a "saw action" of the uncut paper against a blade edge of the blade.

11. The method of claim 9, further comprising the step of immobilizing the leading edge of the uncut paper between the rolled paper holder and the rolled paper.

12. A paper cutting device comprising:

a rolled paper holder configured to receive an elongated section of a roll of paper within a hollow interior bounded by a sidewall having a sidewall thickness thereof, said rolled paper holder having an open front end, an open back end and a middle section between the front end and the back end defining a length along a long axis thereof;

an interstice parallel to the long axis of the rolled paper holder running from the open front end toward the back end, and defining a gap within and bounded by the approximate sidewall thickness of the holder and between a first edge along a top portion of the holder and a first edge along a bottom portion of the holder substantially facing the first edge along the top portion; and a paper cutting knife blade including a sharp edge that faces towards the front end of the rolled paper holder extending into the gap, said sharp edge configured to cut a leading edge of the elongated section of rolled paper received within the rolled paper holder.

13. The paper cutting device of claim 12, wherein the interstice runs axially along an entire length of the sidewall from the open front end to the open back end and including a hinge configured to pivot the top portion of the rolled paper holder with respect to the bottom portion responsive to compressive pressure applied to exterior surfaces of the top and bottom portions of the rolled paper holder to thereby decrease a width of the gap, said hinge running axially along the rolled paper holder from the front end to the back end.

14. The paper cutting device as recited in claim 12, wherein the sharp edge of the paper cutting knife blade includes a forward edge and a back edge, the forward edge being disposed closer to the open front end of the rolled paper holder than the back edge of the cutting knife blade and configured so that the leading edge of the elongated section of rolled paper received within the rolled paper holder first contacts the forward edge and slides along the sharp edge of the paper cutting knife blade toward the back edge.

15. The paper cutting device of claim 12, wherein the gap is disposed within the rolled paper holder substantially parallel to the long axis of the rolled paper holder.

16. The paper cutting device of claim 12, wherein the interstice runs axially along an entire length of the sidewall from the open front end to the open back end, the paper cutting device further including a slot within the interstice having a paper receiving end exposed to the open front end of the rolled paper holder and a closed back end, whereby the paper cutting knife blade is embedded within the closed back end of the slot.

17. The paper cutting device of claim 16, wherein the slot includes a paper cutting guide at a forward portion thereof, said paper cutting guide having a funnel shaped element configured to guide the leading edge of the rolled paper into the slot and against the paper cutting knife blade.

18. The paper cutting device of claim 17, wherein the funnel shaped element includes an angled surface that narrows a width of the slot from the forward portion rearwardly along the slot, wherein the slot is substantially parallel to the interstice.

19. The paper cutting device of claim 18, wherein the width of the slot is configured with a wide forward portion, a narrowed middle portion, and wide rearward portion adjacent the paper cutting knife blade.

* * * * *